United States Patent [19]

Tondini

[11] Patent Number: 4,802,790

[45] Date of Patent: Feb. 7, 1989

[54] VIBRATING MACHINE FOR EFFECTING TILING

[75] Inventor: Claudio Tondini, Cotignola, Italy

[73] Assignee: Tomecanic, Aubergenville, France

[21] Appl. No.: 103,774

[22] Filed: Sep. 30, 1987

[30] Foreign Application Priority Data

Oct. 1, 1986 [EP] European Pat. Off. ..... 86402146.4

[51] Int. Cl.[4] ..... E04F 21/22; E01C 19/28

[52] U.S. Cl. ..... 404/132; 404/117

[58] Field of Search ..... 404/132, 123, 125, 117

[56] References Cited

U.S. PATENT DOCUMENTS

| | | | |
|---|---|---|---|
| 16,195 | 12/1856 | Thompson | 404/132 |
| 479,242 | 7/1892 | Campbell | 404/132 X |
| 1,102,443 | 7/1914 | Schamell | 404/123 |
| 2,728,277 | 12/1955 | McRae | 404/132 |
| 3,426,660 | 2/1969 | Scott | 404/132 X |

FOREIGN PATENT DOCUMENTS

| | | |
|---|---|---|
| 592314 | 7/1925 | France . |
| 1336783 | 7/1963 | France . |
| 2084149 | 12/1971 | France . |
| 2295189 | 7/1976 | France . |

*Primary Examiner*—Jerome W. Massie
*Assistant Examiner*—Matthew Smith
*Attorney, Agent, or Firm*—Bell, Seltzer, Park & Gibson

[57] ABSTRACT

This invention relates to a vibrating machine for applying tiles on a bonding agglomerate disposed between a surface to be covered and said tiling, said machine constituted by a frame, by an assembly of rollers which, disposed beneath the frame, are mounted on parallel shafts, and by a vibration generating device coupled to the frame, each shaft being immobilized in the direction of rotation with respect to the frame, and bearing a plurality of rollers separated, one from the following one, by a distance, each of the rollers being in addition mounted to rotate on this shaft. According to the invention: (a) the distances separating the two rollers borne by the same shaft are equal; (b) all the rollers present a common length, the distance separating two successive identical rollers being slightly greater than said length; and (c) the rollers borne by the various shafts are disposed in quincunx. One application of the invention is the production of a machine for high-quality laying of tiles.

4 Claims, 3 Drawing Sheets

VIBRATING MACHINE FOR EFFECTING TILING

FIELD OF THE INVENTION

The present invention relates to a vibrating machine for effective tiling.

BACKGROUND OF THE INVENTION

When laying tiles, it is necessary to ensure that the tiles of sandstone, earthenware or like material are properly applied on the flooring on which the tiles are laid (made of conventional mortar or adhesive cement) disposed between the floor and the tiles.

Machines are already known for applying the tiles on said flooring, which operate by generating vibrations at 8000 to 10000 vibrations per minute and transmission of these vibrations to the tiles previously laid on the adhesive cement flooring. This machine comprises a series of parallel rollers which allow the displacement of the machine essentially by rolling on the surface of the tiles.

French Pat. No. 2 295 189 describes such a machine for applying sandstone or like tiles of a tiling on a bonding agglomerate disposed between a surface to be covered and said tiling, said machine constituted by a frame, by an assembly of rollers which, disposed beneath the frame, are mounted on parallel shafts and which present a common tangential plane, and by a vibration generating device coupled to the frame, whilst each shaft is fixed to the frame, being stopped in the direction of rotation with respect to this frame, and bears a plurality of rollers separated, one from the adjacent one, by a distance, each of the rollers borne by said shaft being in addition mounted to rotate on this shaft.

In this known machine, on the one hand, the rollers are not all identical, this resulting in having to make different pieces and consequently increasing the production cost of the complete machine, and, on the other hand, the distances between two successive rollers ae variable, but generally less than the length of a roller, which has two consequences: the volume and the mass of the rollers are considerable and therefore expensive and, during the displacement of the machine, the trace of a roller of a given shaft is systematically covered by that of a roller of the following shaft, this causing considerable friction on the surface of the tiles when the direction of application of the tiles is changed, risking displacing said tiles in undesirable manner.

Briefly, the known machines present several drawbacks, including a sometimes contestable quality of execution of the work and high cost.

It is an object of the invention to propose a novel machine not presenting the drawbacks set forth hereinbelow.

SUMMARY OF THE INVENTION

According to the invention, in the machine mentioned hereinabove, the following is provided:

(a) the distances separating adjacent rollers mounted on the same shaft are substantially equal;

(b) substantially all the rollers are identical and present a common length, the distance separating two adjacent identical rollers being slightly greater than said length; and (c) the identical rollers supported on the various shafts are disposed substantially in a quincunx pattern, with the result that the rectilinear traces capable of being made by the rollers supported by one shaft are not convered by the rectilinear traces capable of being made by the rollers supported by the following shaft.

The following advantageous arrangements are also preferably adopted:

each shaft is fixed on the frame via at least two individual shaft supports, which are particular thereto, which are themselves fixed on the frame and with respect to which rotation of said shaft is stopped, whilst each roller-bearing shaft support comprises a tapped bore which opens out into a shaft support bore supporting said shaft and inside which a first screw is adapted to be introduced completely and to be brought into abument on this part of the shaft in order to stop rotation of the shaft with respect to said support, disengaging, after complete introduction of this first screw, the introduction part of the tapped bore, and a second screw is capable, by cooperating with said introduction part of the tapped bore, of fixing the shaft support on the frame;

one of the shaft supports is disposed between two adjacent rollers mounted on said shaft, this machine further comprising two tubular distance sleeves which surround the roller-bearing shaft, which are disposed on either side of said shaft support and which maintain the spaced apart relationship of the said two rollers;

said distance pieces are identical.

The advantages of a novel machine of this type are such as to overcome the drawbacks set forth hereinbefore.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
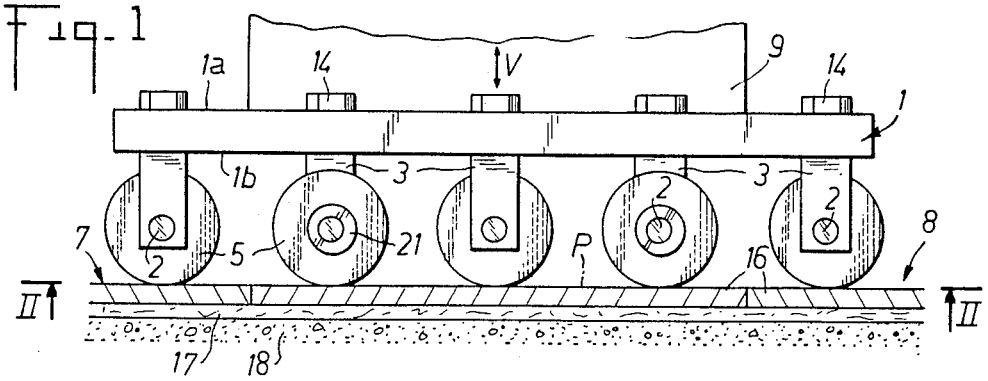
FIG. 1 is a side view in elevation of a machine according to the invention.
Figure 2:
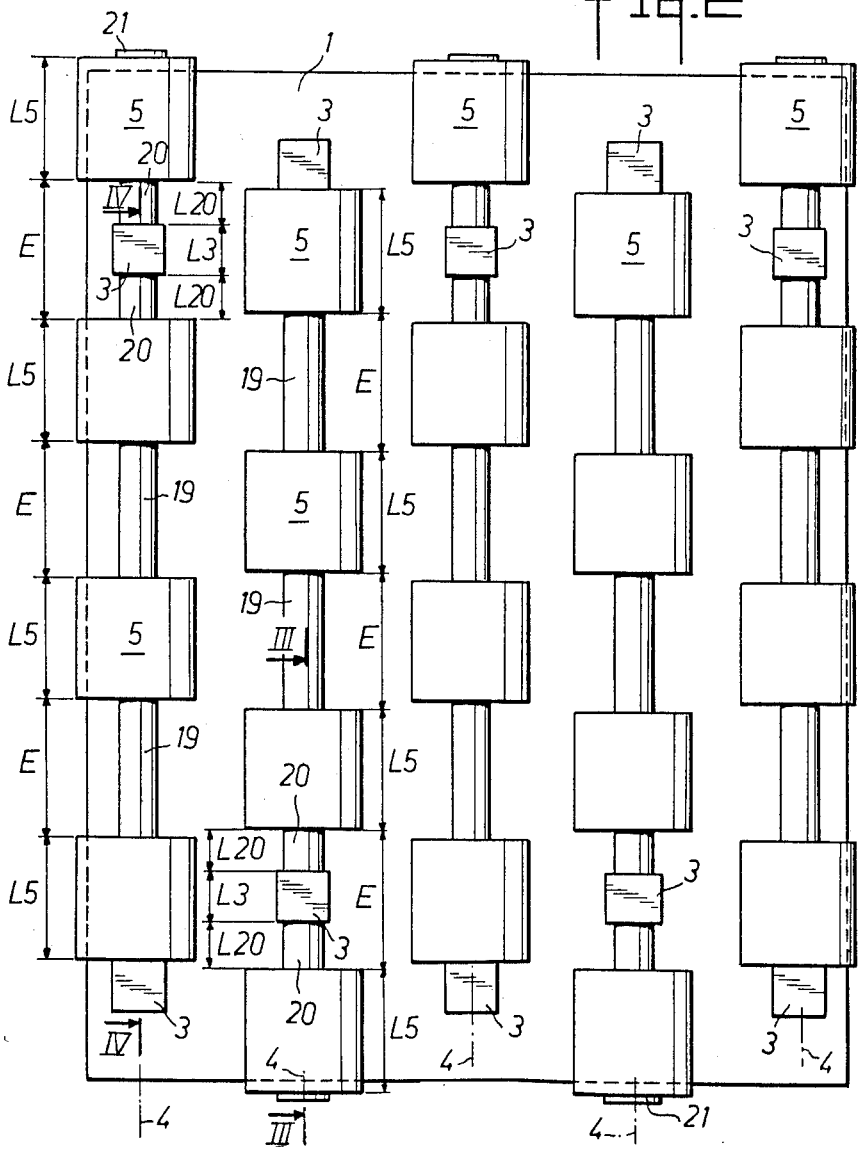
FIG. 2 is a view along II—II of FIG. 1.
Figure 3:
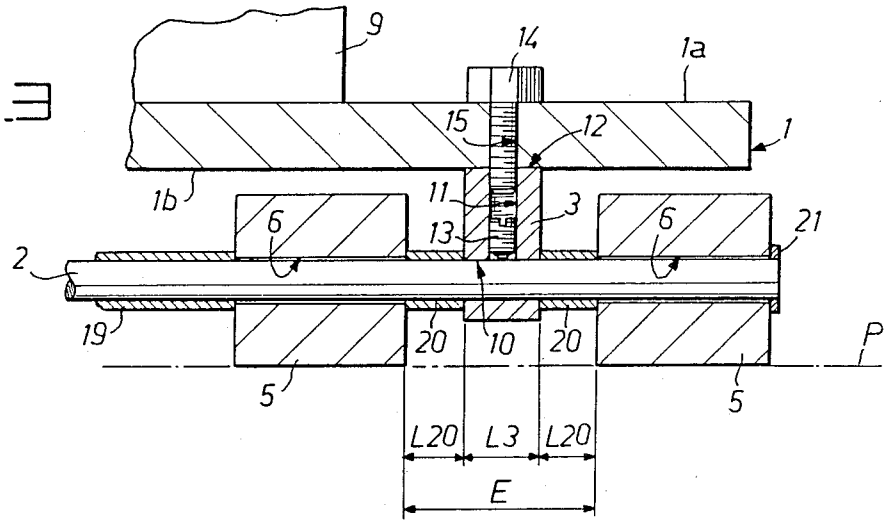
FIGS. 3 and 4 are sections along III—III and IV—IV of FIG. 2, respectively.
Figure 4:
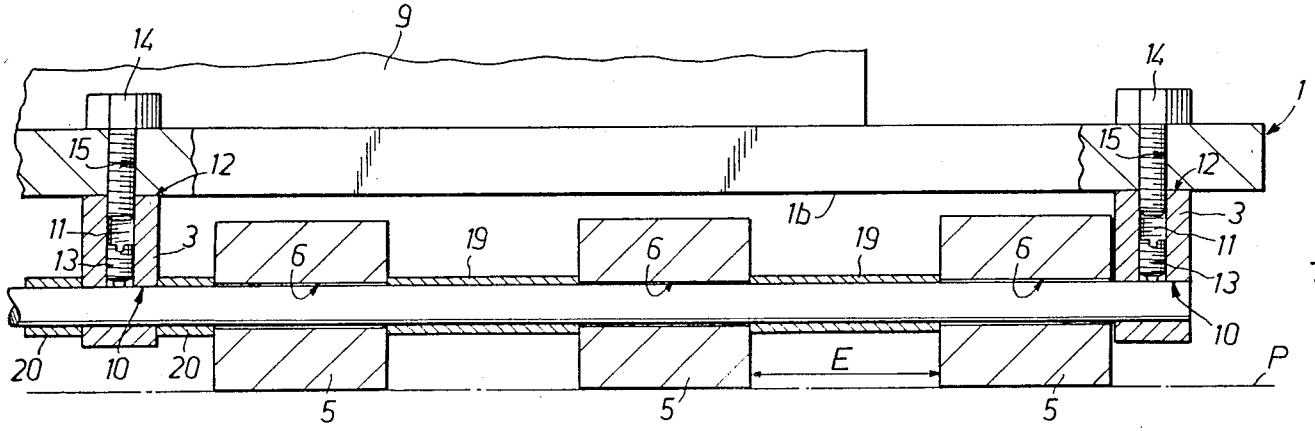

Referring now to the drawings, the machine shown therein comprises:

a frame 1 constituted for example by a plate of cast iron or steel, comprising an upper face 1*a* and a lower face 1*b;* a plurality of shafts 2 which are rigidly fixed on the frame, each by means of two shaft supports 3, and of which the geometrical axes 4 are parallel;

a plurality of rollers 5, all identical to a standard model found on the market, being mounted to rotate on each shaft 2, the bearing for rotation of each roller being constituted by a bore 6 extending therethrough, and the various rollers of the various shafts being disposed so as to have a common tangetial plane P, which merges with the upper face 7 of a tiling 8 in the course of being laid;

a vibration generating device 9 for generating vertical vibrations (V), between 8000 and 10000 per minute, in the whole of the machine, fixed on the upper face 1*a* of the frame 1.

Each shaft support 3 is constituted by a steel parallelepiped, of square section, and including, an upper end, and a lower end with a shaft support bore 10 extending therethrough, forming a housing adapted to be traversed, with a zero or small clearance, by the shaft 2. A bore 11, which is tapped, extends perpendicularly to the axis of the shaft support bore 10 and which opens out at its lower end into said shaft support bore 10, and at its upper end onto a square section face 12 on the upper end of the shaft support 3. A first screw 13 cooperates with the lower portion of the tapped bore 11 and penetrates entirely until it comes into abutment on the shaft 2 previously introduced into the shaft support bore 10 and thus maintains the shaft 2 within the shaft support 3. A second screw 14 traverses a hole 15 made in the frame 1 and, after application of the face 12 of the support 3 on the lower face 1*b* of the frame 1, cooperates with that upper part of the tapped bore 11, left free by the first screw 13, to fix the support 3 on the frame 1.

The upper face 7 of the tiling is that of sandstone or earthenware tiles 16 laid on a flooring 17, made of adhesive cement or the like, spread over a floor 18 having to be covered with tiles 16.

Each roller 5 has a length L5 and is maintained spaced from the adjacent one by a distance E slightly greater than L5.

The shaft supports 3 are furthermore disposed either at one end of each shaft, or between two adjacent rollers 5.

Two rollers 5 which are adjacent to each other and between which no support 3 is disposed, are maintained spaced apart by distance E by means of a tubular distance spacer sleeve 19 which is fitted on shaft 2 and has a length equal to E.

Two rollers 5 which are adjacent to each other and between which is disposed a support 3, are maintained spaced apart by distance E by means of the support 3 of width L3 and two identical tubular distance spacer sleeves 20, each of length L20, disposed, one, between one of the rollers 5 and a first side of the support 3, the other between the other roller 5 and the side of the support 3 opposite said first side of the support.

Of course: $L3+(L20)\times 2=E$.

Figure 5:
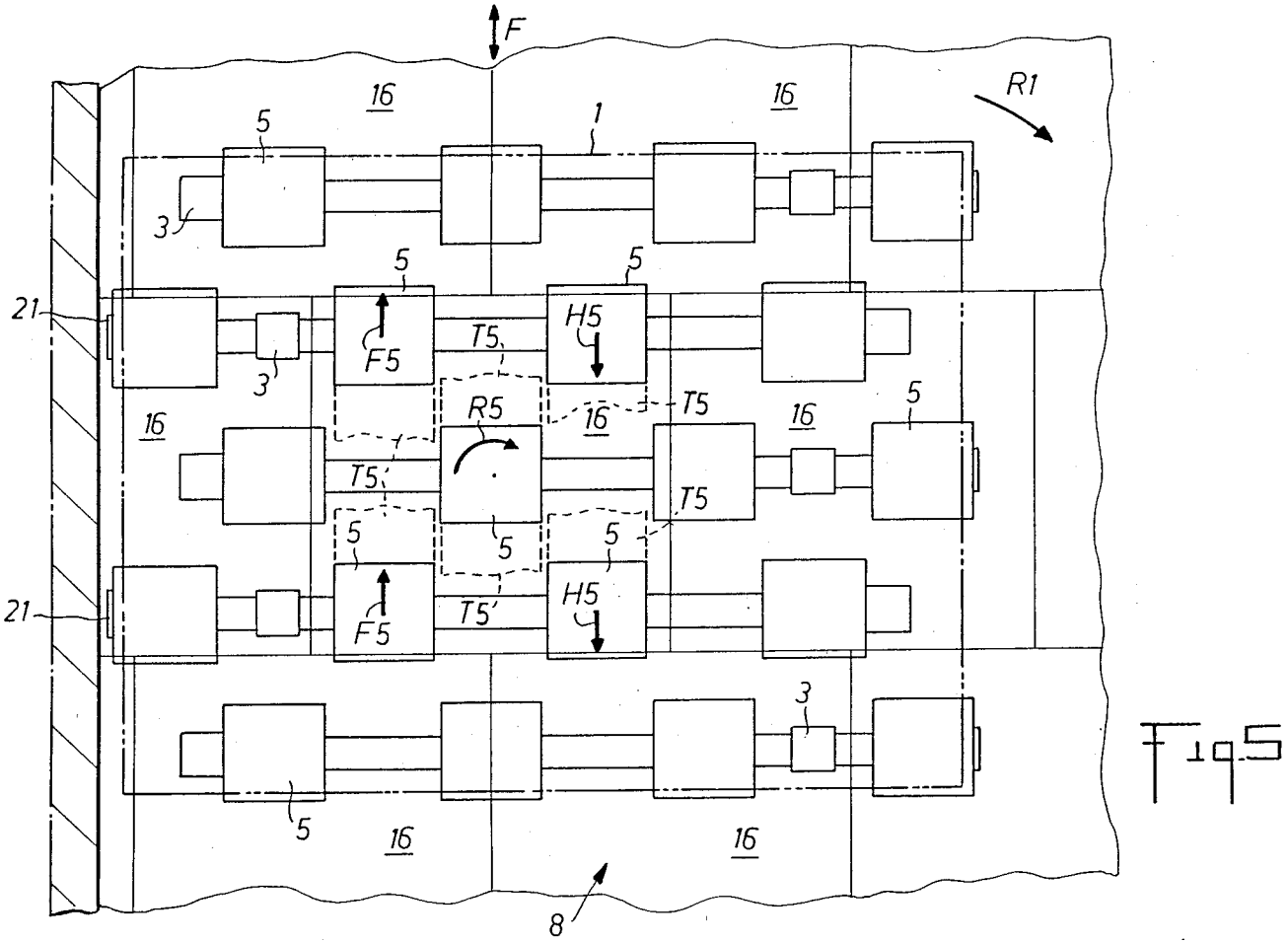
FIG. 5 is a plan view of the rollers of the machine of FIG. 1.

The following arrangements should be noted:

one end of each shaft 2 is fixed on a support 3, the other end including a flange 21 for maintaining in position the adjacent roller 5 on the corresponding shaft 2;

the various shafts are fixed to the frame 1 in positions such that the various rollers are themselves regularly disposed in quincunx, a determined roller therefore being disposed opposite two empty locations, without rollers, of the shafts disposed on either side of the one on which is mounted said determined roller; if it is assumed, with regard to FIG. 5, that the machine advances in either one of the two directions of direction F, it is noted that the rectilinear trace T5 of one roller does not overlap those of the rollers closest to the adjacent shafts;

the lengths of the shafts 2 and their positions with respect to the frame 1 result in two rollers 5 or more slightly projecting from the frame, making it possible to pass along a wall without damaging it with the frame;

the lengths L5 and distance E are generally selected (FIG. 5) so that consecutive rollers may overlap the same tile 16 to be laid, at least as far as the conventional dimensions of tiles are concerned;

with regard to FIG. 5, various tiles 16 have been shown, the central square tile being overlapped, in the vicinity of its four corners, by four rollers 5 and at the centre by a fifth roller 5: arrows F5, H5 (opposite F5), and R5 represent the direction of the displacements of the various rollers 5, during a desired change (arrow R1) in the displacement of the machine (and of the frame 1).

The advantages inherent in the novel machine which has just been described are numerous, for example:

The machine, which is relatively heavy, of the order of 20 to 30 kg, which moves over rollers mounted to rotate with respect to its frame 1 and which, by function, is animated by vibrations, is mounted on very numerous and very wide bearings for rotation, constituted by all the bores 6 of the rollers 5; in this way, the efforts on each bearing have a low value, much lower than that existing in the bearings of the frame which provided the rotating assembly of the shafts of certain prior art machines.

Correlatively, immobilization of the shafts 2 of this novel machine with respect to the frame 1 via the supports 3 strengthens the resistance of the machine.

Manufacture of the machine or of a range of machines of different dimensions, is easy and inexpensive, in any case much less expensive than that of the prior art machines; in fact, a novel feature is that the rollers 5, shafts 2, shaft supports 3 are standard elements found on the market, not special, therefore not manufactured especially and mass-produced, and consequently with low cost price; moreover, the shaft supports 3 being distinct from frame 1, and individual for each shaft 2, it is easy to mount on the frame the desired number of roller-bearing shafts 2: it suffices to choose the dimensions of the frame 1 adapted to the number of shafts 2 chosen and to the number of rollers 5 mounted on each shaft and to bore the corresponding holes 15 for passage of screws 14.

Fixation of shafts 2 is very reliable, as, after positioning of screws 14 for fixing the supports 3 to the frame 1, the screws 13 for fixing the shafts 2 in the supports 3 are captive and there is no risk of their escaping.

Only two types of tubular distance spacer sleeves 19 and 20 allow assembly of the rollers 5 on the shafts 2, in any desired number per shaft, and are constituted by ordinary sections of tubes.

The total weight of the rollers 5 is furthermore considerably reduced with respect to the prior art machines in which the rollers extended continuously, or substantially continuously, except in the zone of the bearings wherre they are rotatably mounted, over the total width of the frame, whilst in the novel machine, there are no rollers in the zone of the spacer elements, i.e. at several locations, of width E for each shaft 2.

The reduction in weight of the rollers 5, already advantageous from the standpoint of use of the machine, which is easier to guide than the prior art machines, is also advantageous as regards the volume and cost of the material constituting said rollers 5.

The discontinuity, a novel feature, of the assembly of the rollers mounted on the same shaft 2, is additionally advantageous as far as the quality of the work effected is concerned: when the user intends to pivot his machine above the surface of the tiling 8 (arrow R1 in FIG. 5), the rollers 5 corresponding to arrows F5 and H5 roll virtually without friction over the corresponding tile 16: only the central roller 5 must pivot on itself in the direction of arrow R5 and tends, by friction, to take the tile 16 on which it rests, along in the same direction; however, it should be noted that, although such friction remains inconvenient, it is much less than that caused by the continuous rollers of the prior art machines: in those machines, the friction was that of three parallel rollers extending over the whole width of the tile 16, and the effort of pivoting acting on tile 16 in the direction of arrow R5 was considerable; this important operational advantage is naturally obtained thanks to the judicious choice of the relative dimensions of the distance E separating two rollers mounted on the same shaft and of the length L5 of a roller, distance E being slightly greater than length L5, and to the adoption of the quincunx disposition of the rollers mounted on the successive shafts;

Furthermore, it is obvious that worn out parts of the novel machine may be replaced with ordinary new spare parts at a low cost, and, in addition, with non-specialized manpower, as there is no delicate mechanical adjustment to be made, which was not the case with the assembly of the shafts of the prior art machines in special bearings.

The invention is not limited to the embodiment shown but covers, on the contrary, all the variants which may be made thereto without departing from its scope nor its spirit.

What is claimed is:

1. In a vibrating machine for applying sandstone or like tiles (16) on a bonding agglomerate (17) disposed between a surface (18) to be covered and said tiles (16), said machine including a frame (1), an assembly of rollers (5) disposed beneath said frame (1) and mounted on parallel shafts (2) with their lower surfaces positioned along a common tangential plane (P), and a vibrating generating device (9) coupled to said frame (1), and wherein each of said shafts (2) is fixed beneath said frame (1) and being stopped in the direction of rotation with respect to said frame (1), said assembly of rollers (5) on each of said shafts (2) being separated, one from the adjacent one, by a distance (E), and each of said rollers (5) being mounted to rotate on said shafts (2), the combination therewith in which (a) said distances (E) separating adjacent rollers (5) mounted on the same shaft (2) are substantially equal, (b) substantially all of said rollers (5) are identical and are of a common length (L5), said distances (E) separating two adjacent identical rollers (5) being greater than said length (L5), and (c) said identical rollers (5) supported on said shafts (2) are disposed substantially in a quincunx pattern so that the rectilinear traces (T5) capable of being made by said rollers (5) supported by one of said shafts (2) are not convered by the rectilinear traces (T5) capable of being made by said rollers (5) supported by the following of said shafts (2).

2. In a vibrating machine according to claim 1 wherein each of said shafts (2) is fixed on said frame (1) by means of shaft supports (3) each including an upper end fixed on said frame (1) and a lower end with a shaft support bore (10) extending therethrough for supporting said shaft (2) therein, a tapped bore (11) extending perpendicular to said shaft support bore (10) and extending upwardly therefrom to the upper end of said shaft support (3), a first screw (13) disposed completely in the lower end of said tapped bore (11) and being engaged with said shaft (2) to maintain the same in said shaft support bore (10), and a second screw extending through said frame (1) and into the upper end of said tapped bore (11) to fix the upper end of said shaft support (3) on said frame (1).

3. In a vibrating machine according to claim 2 wherein one of said shaft supports (3) is disposed between two adjacent rollers (5) on each of said parallel shafts (2) and including a tubular distance spacer sleeve (20) positioned on each side of said shaft support (3) and surrounding said shaft (2) for maintaining the spaced-apart relationship of said two adjacent rollers (5).

4. In a vibrating machine according to claim 3 wherein said distance sleeves (20) are of identical length (L20).

* * * * *